US011311111B2

(12) United States Patent
Grutta et al.

(10) Patent No.: US 11,311,111 B2
(45) Date of Patent: Apr. 26, 2022

(54) VENTILATED MATTRESSES

(71) Applicant: Purple Innovation, LLC, Lehi, UT (US)

(72) Inventors: James T. Grutta, Draper, UT (US); Brett Pearson, Taylorsville, UT (US); Aubree Carter, Lehi, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

(21) Appl. No.: 17/223,970

(22) Filed: Apr. 6, 2021

(65) Prior Publication Data

US 2021/0307527 A1 Oct. 7, 2021

Related U.S. Application Data

(60) Provisional application No. 63/005,911, filed on Apr. 6, 2020.

(51) Int. Cl.

| | |
|---|---|
| ***A47C 21/04*** | (2006.01) |
| ***A47C 27/10*** | (2006.01) |
| ***A47C 27/08*** | (2006.01) |
| ***A47C 27/18*** | (2006.01) |
| ***A47C 27/14*** | (2006.01) |

(52) U.S. Cl.

CPC ..... *A47C 21/044* (2013.01); *A47C 27/082* (2013.01); *A47C 27/083* (2013.01); *A47C 27/10* (2013.01); *A47C 27/146* (2013.01); *A47C 27/18* (2013.01); *A47C 27/142* (2013.01)

(58) Field of Classification Search

CPC ..... A47C 21/044; A47C 21/042; A47C 21/04; A47C 27/081; A47C 27/082; A47C 27/083; A47C 27/10; A47C 27/18; A47C 27/142; A47C 27/144; A47C 27/146

USPC ..... 5/423, 421, 284, 652.1, 652.2, 724, 726, 5/730, 736

See application file for complete search history.

(56) References Cited

U.S. PATENT DOCUMENTS 4,862,538 A * 9/1989 Spann ..... A61G 7/05707 5/730
5,025,519 A * 6/1991 Spann ..... A61G 7/05707 5/724
5,252,278 A * 10/1993 Spann ..... A61G 7/05707 264/138

(Continued)

FOREIGN PATENT DOCUMENTS

GB 2274054 A * 7/1994 ..... A47C 27/148

OTHER PUBLICATIONS

USPTO as International Searching Authority, "International Search Report and Written Opinion," International Application No. PCT/US2021/026033, dated Jul. 8, 2021.

*Primary Examiner* — Robert G Santos
(74) *Attorney, Agent, or Firm* — Dentons Durham Jones Pinegar

(57) ABSTRACT

A ventilated mattress includes a ventilation system with an air distribution layer and a gel cushioning layer over the air distribution layer. The air distribution layer may include channels in a surface thereof, while voids that extend through an entire thickness of the gel cushioning layer may include voids that communicate with the channels. As the ventilation system forces air into the air distribution layer, the air may flow through the channels, into and through the voids of the gel cushioning layer, and to a top of the ventilated mattress.

20 Claims, 13 Drawing Sheets

(56) References Cited

U.S. PATENT DOCUMENTS 5,444,881 A * 8/1995 Landi ..... A61G 5/1043 5/708
5,617,595 A * 4/1997 Landi ..... A61G 5/1043 297/452.41
5,701,621 A * 12/1997 Landi ..... A61G 5/1043 428/116
5,749,111 A * 5/1998 Pearce ..... C08L 51/006 5/654
5,887,304 A 3/1999 von der Heyde
6,026,527 A * 2/2000 Pearce ..... C08L 51/006 5/654
6,212,720 B1 * 4/2001 Antinori ..... A47C 27/086 5/716
6,413,458 B1 7/2002 Pearce
6,797,765 B2 9/2004 Pearce
7,036,163 B2 5/2006 Schmid
7,036,173 B2 * 5/2006 Gladney ..... A47C 27/20 5/716
7,060,213 B2 6/2006 Pearce
7,076,822 B2 * 7/2006 Pearce ..... B29C 48/919 5/655.5
7,181,786 B2 2/2007 Schoettle
7,240,386 B1 7/2007 McKay et al.
7,424,763 B2 * 9/2008 Gladney ..... A47C 27/20 5/716
7,469,432 B2 12/2008 Chambers
7,509,998 B1 3/2009 Rodney
7,631,377 B1 12/2009 Sanford
7,950,084 B1 5/2011 McKay et al.
7,964,664 B2 6/2011 Pearce
7,975,331 B2 7/2011 Flocard et al.
8,065,763 B2 11/2011 Brykalski et al.
8,181,290 B2 * 5/2012 Brykalski ..... A61G 7/05 5/423
8,191,187 B2 6/2012 Brykalski et al.
8,250,689 B2 * 8/2012 Gladney ..... A47C 27/142 5/729
8,307,482 B2 * 11/2012 Gladney ..... A47C 27/148 5/727
8,353,069 B1 1/2013 Miller
8,418,285 B2 4/2013 Frias
8,418,286 B2 * 4/2013 Brykalski ..... A47C 21/044 5/423
8,578,527 B2 11/2013 Lachenbruch et al.
8,621,687 B2 1/2014 Brykalski et al.
8,640,281 B2 2/2014 Frias
8,732,874 B2 5/2014 Brykalski et al.
8,745,784 B2 6/2014 Cole et al.
8,782,830 B2 * 7/2014 Brykalski ..... A47C 21/048 5/423
8,881,328 B2 11/2014 Mikkelsen et al.
8,910,334 B2 * 12/2014 Lafleche ..... A61G 7/05715 5/713
8,918,935 B2 * 12/2014 Gladney ..... A47C 27/148 5/730
8,919,750 B2 12/2014 Pearce et al.
9,066,601 B1 6/2015 Aminy et al.
9,119,479 B2 9/2015 Mikkelsen et al.
9,125,497 B2 9/2015 Brykalski et al.
9,131,781 B2 9/2015 Zaiss et al.
9,192,244 B2 11/2015 Rand
9,259,099 B1 * 2/2016 Larsen ..... A47C 21/046
9,265,352 B2 * 2/2016 Oakhill ..... A47C 21/044
9,326,616 B2 * 5/2016 DeFranks ..... A47C 21/044
9,408,475 B2 8/2016 Mikkelsen et al.
9,462,893 B2 10/2016 Romano et al.
9,474,384 B2 10/2016 Rawls-Meehan et al.
9,549,620 B2 * 1/2017 Gladney ..... A47C 27/148
9,603,459 B2 3/2017 Brykalski et al.
9,622,588 B2 * 4/2017 Brykalski ..... A47C 21/04
9,756,952 B2 * 9/2017 Alletto, Jr. ..... A47C 21/044
9,756,953 B2 * 9/2017 DeFranks ..... A47C 27/05
9,782,016 B2 10/2017 Aramli
9,814,641 B2 11/2017 Brykalski et al.
9,835,344 B2 12/2017 Vrzalik et al.
9,854,921 B2 * 1/2018 DeFranks ..... A47C 27/05
9,888,782 B1 * 2/2018 Jannke ..... A47C 21/044
9,907,407 B2 3/2018 Aramli
9,913,546 B2 3/2018 Chandler
9,913,770 B2 3/2018 Lachenbruch et al.
9,943,172 B2 4/2018 Lachenbruch
9,955,791 B2 5/2018 Chandler et al.
9,974,394 B2 5/2018 Brykalski et al.
10,047,981 B2 8/2018 Parish et al.
10,051,973 B2 8/2018 Morgan et al.
10,136,735 B2 11/2018 Ocegueda et al.
10,226,134 B2 * 3/2019 Brykalski ..... A61G 7/05
10,499,755 B2 12/2019 Aramli
10,524,581 B2 1/2020 Aramli
10,568,436 B2 2/2020 Alletto et al.
10,582,776 B2 3/2020 Aramli
10,588,419 B2 3/2020 Aramli
10,660,450 B2 5/2020 Harada et al.
10,660,451 B2 5/2020 Aramli
10,675,198 B2 6/2020 Brykalski et al.
10,806,267 B1 10/2020 Aramli
10,820,714 B2 11/2020 Boersma et al.
10,827,846 B2 11/2020 Karschnik et al.
10,881,217 B2 1/2021 Moon et al.
10,898,009 B2 * 1/2021 Alletto, Jr. ..... A47C 21/048
2004/0074007 A1 * 4/2004 Gladney ..... A47C 23/04 5/727
2004/0226098 A1 * 11/2004 Pearce ..... A47C 4/54 5/655.5
2006/0179580 A1 * 8/2006 Robertson ..... A47C 27/148 5/730
2006/0195988 A1 * 9/2006 Gladney ..... A47C 27/064 5/730
2009/0106907 A1 4/2009 Chambers
2009/0139033 A1 * 6/2009 Gladney ..... A47C 27/20 5/716
2010/0005595 A1 * 1/2010 Gladney ..... A47C 27/148 5/691
2010/0011502 A1 * 1/2010 Brykalski ..... A47C 21/04 5/423
2010/0146709 A1 * 6/2010 Lafleche ..... A61G 7/05784 5/713
2010/0175196 A1 * 7/2010 Lafleche ..... A61G 7/05784 5/707
2011/0173757 A1 * 7/2011 Rensink ..... A47C 27/15 5/698
2012/0227182 A1 * 9/2012 Brykalski ..... A47C 21/048 5/423
2012/0297546 A1 * 11/2012 Gladney ..... A47C 27/148 5/716
2013/0025068 A1 1/2013 Chunglo
2013/0227783 A1 * 9/2013 Brykalski ..... A47C 21/04 5/423
2014/0189951 A1 * 7/2014 DeFranks ..... A47C 21/044 5/423
2014/0310874 A1 * 10/2014 Brykalski ..... A47C 21/04 5/423
2015/0040327 A1 * 2/2015 Mikkelsen ..... A47C 27/15 5/740
2015/0074904 A1 3/2015 Aramli
2015/0107027 A1 * 4/2015 Gladney ..... A47C 27/20 5/720
2015/0208814 A1 * 7/2015 Alletto, Jr. ..... A47C 27/00 5/423
2015/0261631 A1 9/2015 Kurihara
2015/0289667 A1 * 10/2015 Oakhill ..... A47C 21/044 5/423
2016/0166073 A1 * 6/2016 Oakhill ..... A47C 21/048 5/613
2016/0198861 A1 * 7/2016 DeFranks ..... A47C 27/064 5/423
2017/0071359 A1 3/2017 Petrovski et al.
2017/0251825 A1 9/2017 Pearce
2017/0273470 A1 9/2017 Brykalski et al.
2017/0290437 A1 * 10/2017 Brykalski ..... A47C 21/04

(56) References Cited

U.S. PATENT DOCUMENTS

| | | | | |
|---|---|---|---|---|
| 2017/0325595 | A1* | 11/2017 | DeFranks | A47C 21/044 |
| 2017/0340128 | A1 | 11/2017 | Aramli | |
| 2018/0098637 | A1 | 4/2018 | Griese et al. | |
| 2018/0289170 | A1* | 10/2018 | Alletto, Jr. | A47C 21/044 |
| 2018/0289171 | A1* | 10/2018 | Alletto, Jr. | A47C 21/044 |
| 2019/0150631 | A1* | 5/2019 | Pearce | A47C 27/088 |
| 2019/0150632 | A1 | 5/2019 | Pearce et al. | |
| 2020/0000242 | A1 | 1/2020 | Ermalovich et al. | |
| 2020/0037776 | A1* | 2/2020 | Brykalski | A47C 21/04 |
| 2020/0170417 | A1* | 6/2020 | Alletto | A47C 21/042 |
| 2020/0352345 | A1 | 11/2020 | Micklos | |
| 2021/0037987 | A1 | 2/2021 | Griffith et al. | |
| 2021/0038454 | A1 | 2/2021 | Brykalski et al. | |
| 2021/0251393 | A1 | 8/2021 | Harris et al. | |
| 2021/0307527 | A1* | 10/2021 | Grutta | A47C 21/044 |

* cited by examiner

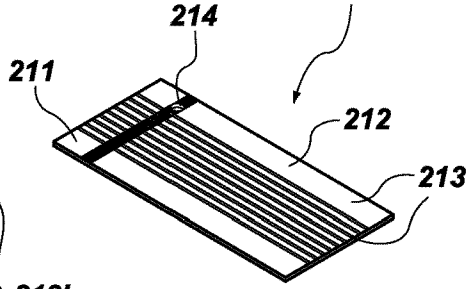
FIG. 12A
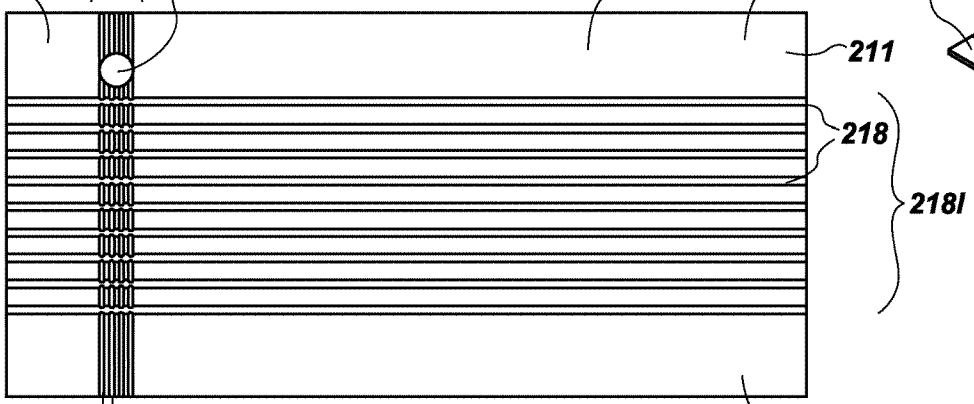
FIG. 12B
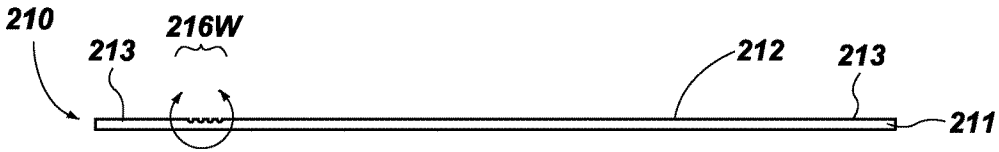
FIG. 12C
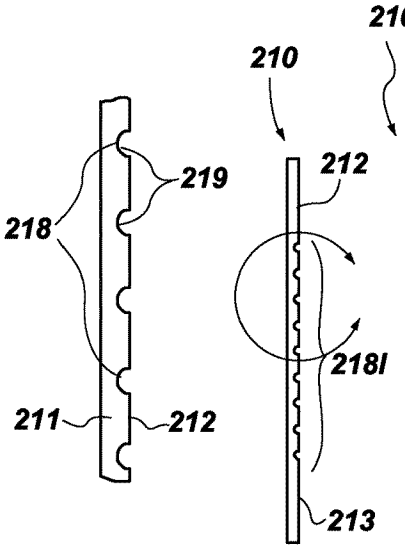
FIG. 12D
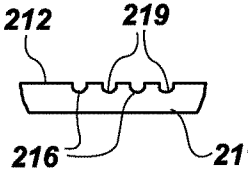
FIG. 12E
FIG. 12F

VENTILATED MATTRESSES

CROSS-REFERENCE TO RELATED APPLICATION

A claim to the benefit of the Apr. 6, 2020 filing date of U.S. Provisional Patent Application 63/005,911, titled VENTILATED COMPOSITE MATTRESSES ("the Provisional Application") is hereby made pursuant to 35 U.S.C. § 119(e). The entire disclosure of the '911 Provisional Application is hereby incorporated herein.

TECHNICAL FIELD

This disclosure relates generally to ventilated mattresses with and, more specifically, to ventilated mattresses that include gel layers. Such mattresses may comprise composite mattresses with a gel layer near the top thereof and one or more other types of mattress cushioning beneath the gel layer. Cushioning methods are also disclosed.

DISCLOSURE

Various embodiments of mattresses are disclosed that combine the comfort of a gel mattress with ventilation and, optionally, with the durability and/or versatility of one or more other mattress technologies.

A mattress according to this disclosure may be referred to as a "ventilated mattress." Such a mattress may include a ventilation system and a gel cushioning layer over the ventilation system.

In embodiments where the mattress combines two or more mattress technologies, the mattress may be referred to as a "composite ventilated mattress." Such a mattress may include at least one base cushioning layer, a ventilation system over the at least one base cushioning layer, and a gel cushioning layer over the ventilation system.

In some embodiments, the mattress may include two or more base layers. Even more specifically, a first base cushioning layer of a mattress according to this disclosure may include an array of mattress coils, while a second base cushioning layer of a mattress according to this disclosure may include an air bladder.

An intervening layer may be disposed between the first base cushioning layer and the second base cushioning layer. The intervening layer may provide a protective barrier between the first base cushioning layer and the second base cushioning layer; for example, it may prevent puncturing of the air bladder of the second base cushioning layer by springs of the coils of the first base cushioning layer. Alternatively or additionally, the intervening layer may facilitate coupling of the first base cushioning layer and the second base cushioning layer.

The first base cushioning layer, the second base cushioning layer, and any intervening layer may be positioned within a frame that defines a pocket of the mattress; i.e., they may be disposed within the pocket. The frame may itself be formed from a cushioning material, such as a foam rubber. The frame may include a base (e.g., a layer of foam rubber, etc.), as well as four edge rails—two end rails and two side rails (e.g., edge foam pieces, etc.)—positioned on or adjacent to end and side edges of the base and defining the pocket of the frame above the base. The frame may include ventilation features that facilitate airflow therethrough, which ventilation features may enable air to be drawn from a location outside the ventilated mattress into the ventilation equipment, which may then force the air to locations across a top surface of the mattress.

The pocket of the frame may have at least one lateral dimension (e.g., a length or a width) that exceeds the corresponding lateral dimensions of the first base cushioning layer, the second base cushioning layer, and any intervening layer. When the first base cushioning layer, the second base cushioning layer, and any intervening layer are positioned within the pocket, the extra space may define a receptacle that receives ventilation equipment (e.g., one or more pumps, controls, hoses, corresponding supports, an overlying cushioning element, etc.). Thus, the ventilation equipment, including the pump(s) thereof (e.g., an air pump, a ventilation pump, etc.), may reside within the body of the mattress. In a specific embodiment, the receptacle may extend along a foot end of the ventilated mattress or ventilated composite mattress; thus, the ventilation equipment may be positioned within the ventilated mattress or the ventilated composite mattress along the foot end thereof.

A support layer may be positioned over the base cushioning layer(s). The support layer may be formed from foam rubber or a viscoelastic foam material, providing an additional comfort layer over the base cushioning layer(s). In the embodiment of ventilated composite mattress described herein, the support layer may be positioned atop the second base cushioning layer. The support layer may cover the frame; i.e., it may be disposed on edge rails of the frame. In some embodiments, the support layer may be secured to (e.g., with a suitable cement or other adhesive material, etc.) the edge rails of the frame.

In addition to including one or more pumps, controls, hoses, and corresponding supports, a ventilation system of the ventilated mattress or ventilated composite mattress may include an air distribution layer. The air distribution layer, which rests atop the support layer, may comprise a foam layer with channels formed in a top surface thereof. The channels of the air distribution layer may communicate (e.g., by way of one or more hoses, etc.) the pump(s) of the ventilation system.

A top edge may be positioned on or otherwise over the periphery of the air distribution layer. The top edge may include four cushioning rails—two end rails and two side rails. The top edge may define a receptacle, within which the gel cushioning layer of the ventilated mattress or the ventilated composite mattress may be located. The gel cushioning material may comprise any suitable gel cushion, including, but not limited to, those available in the mattresses and other cushions available from Purple Innovation, LLC, of Lehi, Utah.

In another aspect, methods for manufacturing and assembling a ventilated mattress or a composite ventilated mattress are also disclosed. Such methods may include manufacturing and assembling the individual components of such a mattress with each other, selecting a mattress top and a mattress bottom, and/or assembling a mattress top with a mattress bottom.

In a specific embodiment, a method of assembling components of ventilated mattress may include assembling a pump, a control, and a hose of a ventilation system within an interior of a mattress base, an end of the hose protruding from a top of the mattress base. An air distribution layer may be positioned over the mattress base, including positioning the end of the hose that protrudes from the top of the mattress base in an aperture through the air distribution layer. Thus, channels in a top of the air distribution layer communicate with the aperture and the end of the hose. A cushioning layer (e.g., a gel cushioning layer, a gel cushioning layer with a grid configuration, etc.) may be positioned over the air distribution layer. Voids that extend through the cushioning layer may communicate with the channels of the air distribution layer to enable airflow from the channels to pass through the cushioning layer, toward a top of the ventilated mattress.

In yet another aspect, methods for providing ventilation as an individual is supported by a ventilated mattress or a composite ventilated mattress are within the scope of this disclosure.

Other aspects of the disclosed subject matter, as well as features and advantages of various aspects of the disclosed subject matter, should become apparent to those of ordinary skill in the art through the ensuing description, the accompanying drawings, and the appended claims.

BRIEF DESCRIPTION OF THE DRAWINGS

In the drawings:

FIGS. 12A-12D respectively provide isometric, top, side, and end views of an embodiment of an air distribution layer of the ventilation system of the embodiment of ventilated mattress illustrated by FIG. 1; FIGS. 12E and 12F provide enlarged side views of an embodiment of channels in an upper surface of the air distribution layer;

DETAILED DESCRIPTION

Figure 1:
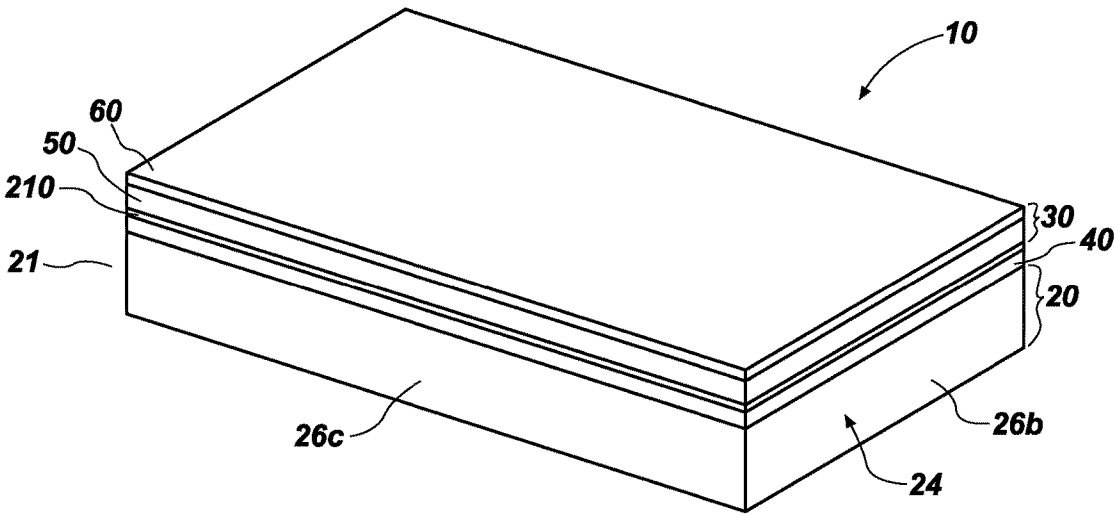
FIG. 1 is an isometric view of the internal elements of an embodiment of ventilated mattress according to this disclosure.
Figure 3:
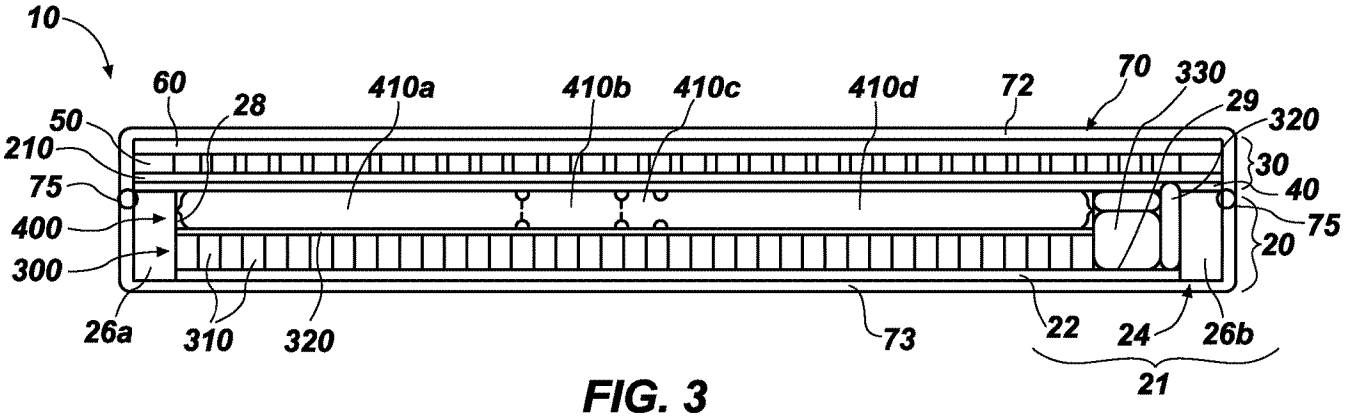
FIG. 3 shows a cross-section through the embodiment of ventilated mattress illustrated by FIG. 1.
Figure 2:
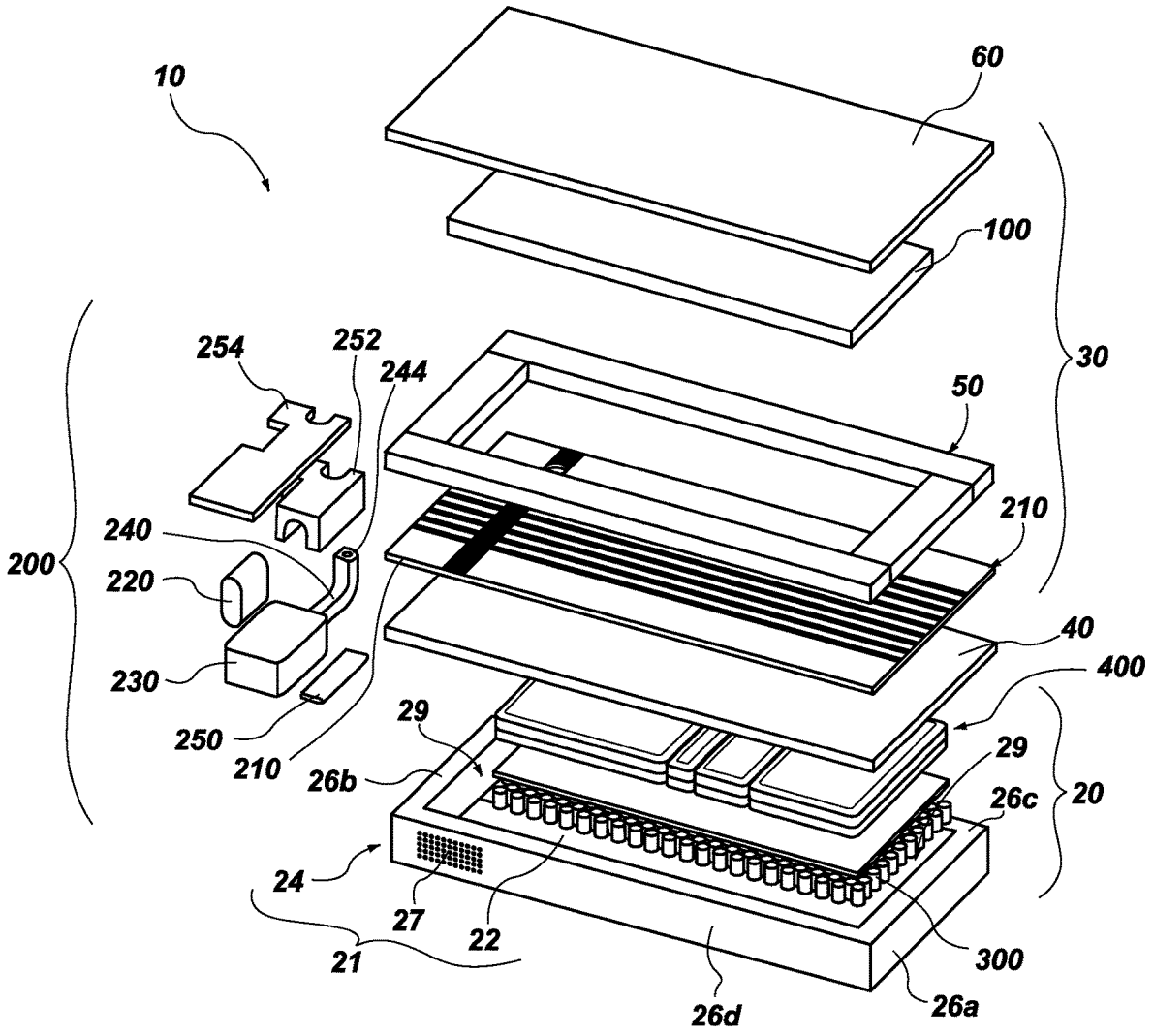
FIG. 2 is an isometric exploded view showing the internal elements of the embodiment of ventilated mattress illustrated by FIG. 1.

With reference to FIGS. 1-3, an embodiment of a ventilated mattress 10 is depicted. The ventilated mattress 10 includes a gel cushioning layer 100 over a ventilation system 200. The gel cushioning layer 100 and the ventilation system 200 may at least partially define a mattress top 30 of the ventilated mattress 10. As illustrated, the gel cushioning layer 100 may be disposed atop an air distribution layer 210 of the ventilation system 200. In addition to the mattress top 30, the ventilated mattress 10 may include a mattress base 20. A support layer 40 may be positioned between the mattress base 20 and the mattress top 30; alternatively, the support layer 40 may serve as at least part of a foundation for the mattress top 30. A cover 70 may enclose or envelop all of the other components of the ventilated mattress 10.

In some embodiments, such as that depicted by FIGS. 1-3, the ventilated mattress 10 may comprise a composite ventilated mattress, with the mattress base 20 comprising at least one cushioning element that employs a different cushioning technology than that of the gel cushioning layer 100. For example, the mattress base 20 of such a ventilated mattress 10 may include a coil layer 300, a pressurizable layer 400, another suitable type of cushioning element for a mattress (e.g., a foam layer, a viscoelastic layer, etc.), or any combination of cushioning elements. In the specific embodiment depicted by FIGS. 1-3, the mattress base 20 includes a coil layer 300 and a pressurizable layer 400 over the coil layer 300. It will be appreciated that a ventilated mattress 10 may include only one of the coil layer 300 or the pressurizable layer 400. Alternatively, either the coil layer 300 or the pressurizable layer 400 may be replaced with a layer that is formed entirely from a foam.

Figure 4A:
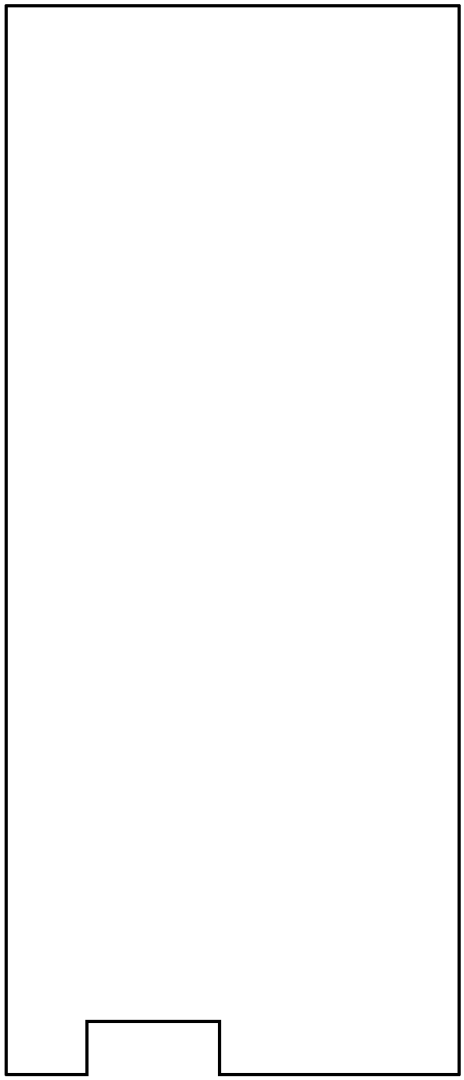
FIGS. 4A and 4B respectively provide a side view and a top view of an embodiment of a base layer of a mattress base of the embodiment of ventilated mattress illustrated by FIG. 1.
Figure 4B:
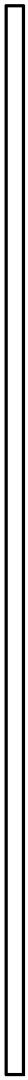
Figure 5B:
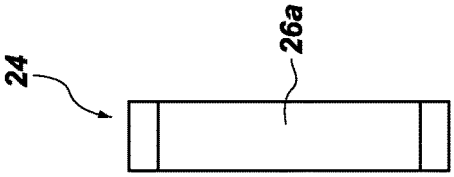
FIGS. 5A-5E provide various views of an embodiment of a frame of the mattress base of the embodiment of ventilated mattress illustrated by FIG. 1.
Figure 5C:
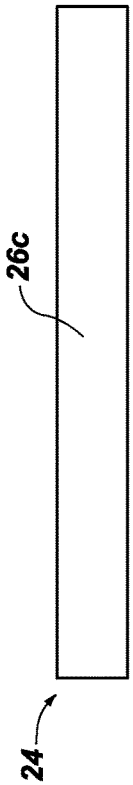
Figure 5A:
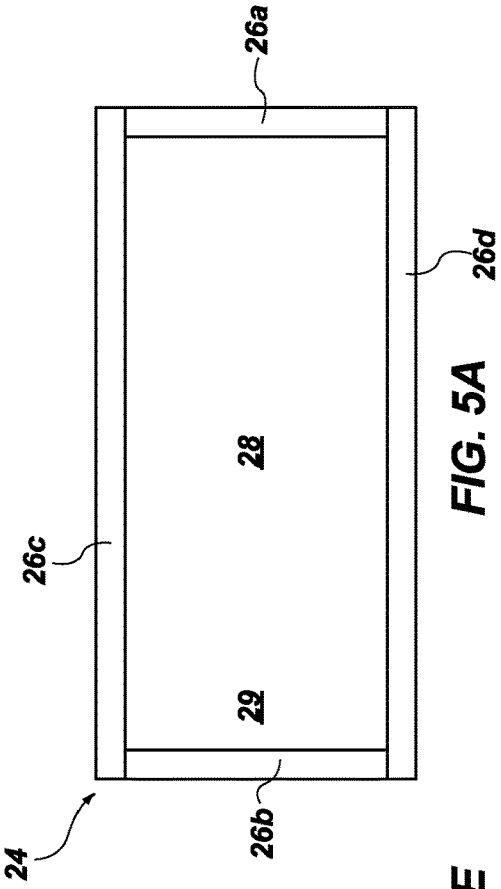
Figure 5D:
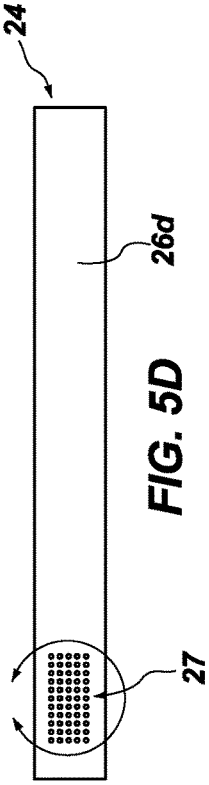
Figure 5E:
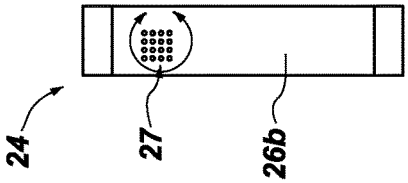
Figure 5F:
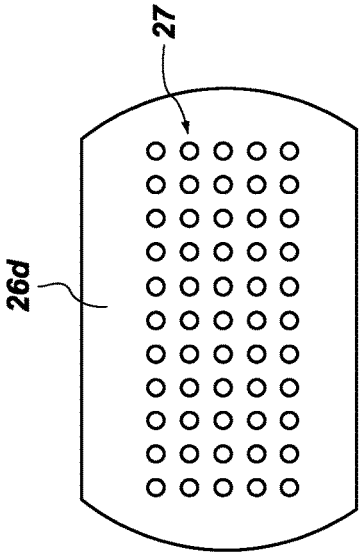
FIGS. 5F and 5G provided enlarged views of an embodiment of ventilation features in the frame.
Figure 5G:
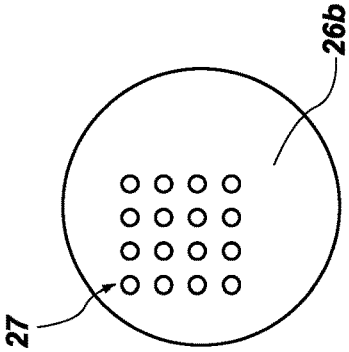
Figure 6A:
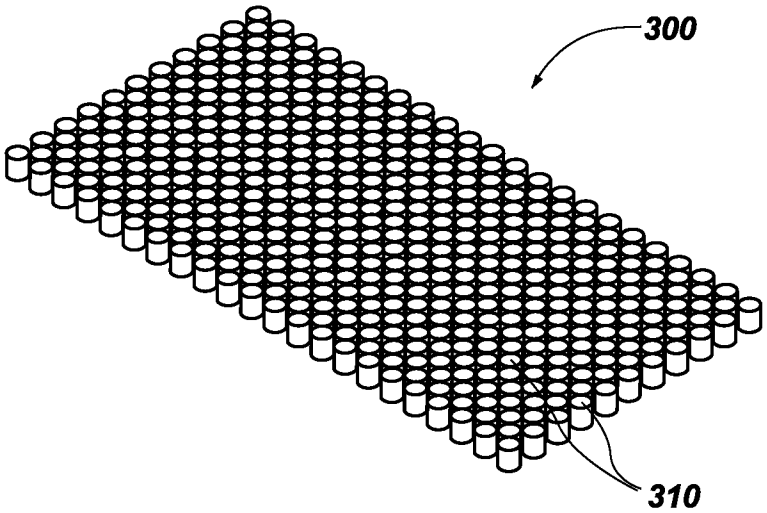
FIGS. 6A-6C respectively provide isometric, top, and side views of an embodiment of a coil layer of the embodiment of ventilated mattress illustrated by FIG. 1.
Figure 6C:
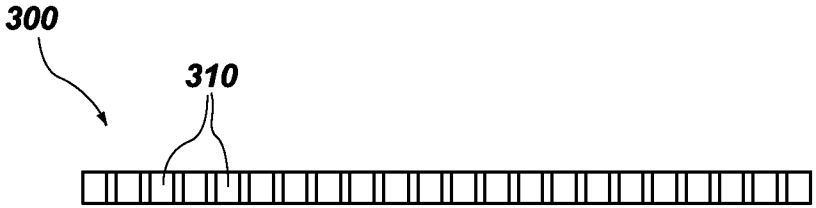
Figure 6B:
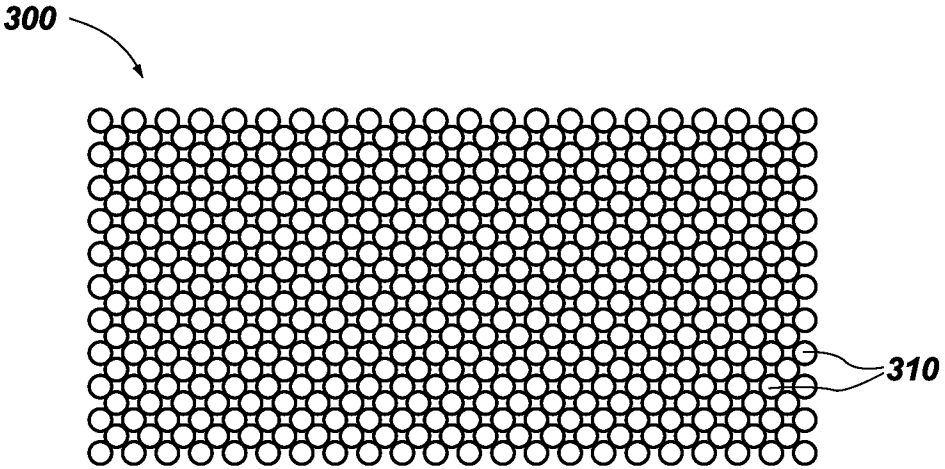
Figure 7B:
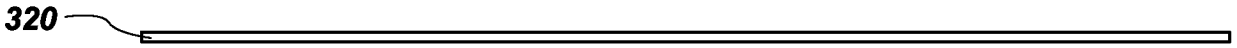
FIGS. 7A and 7B respectively provide top and side views of an embodiment of an intervening layer of the embodiment of ventilated mattress illustrated by FIG. 1.
Figure 7A:
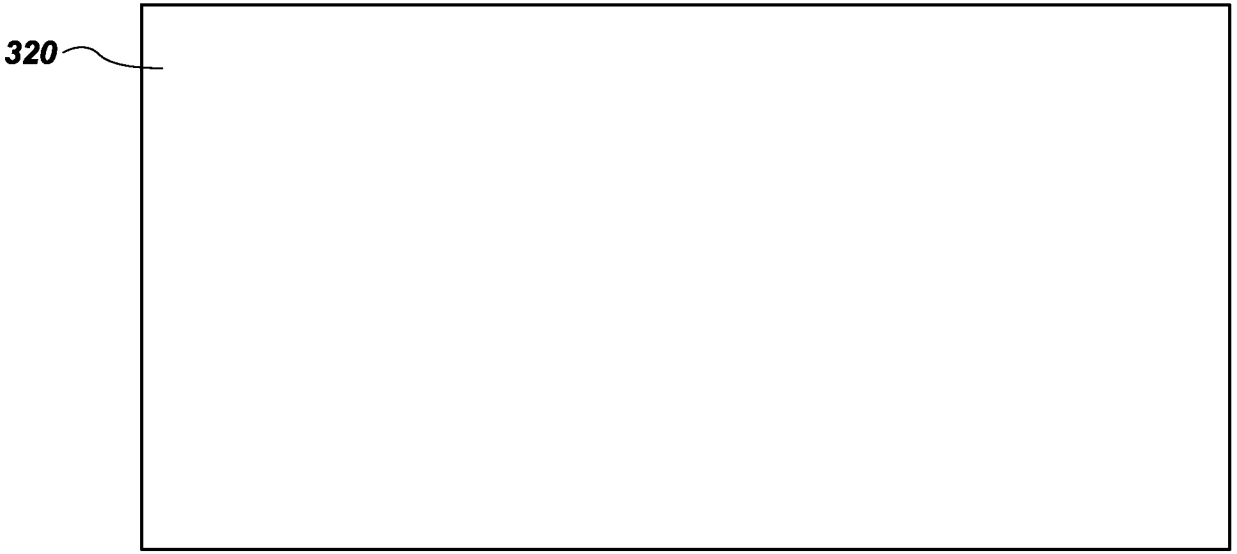

At a bottom of the mattress base 20, the ventilated mattress 10 may include a base layer 22. See FIGS. 1-3; see also FIGS. 4A and 4B. The base layer 22 may provide a barrier between an exterior, base surface 13 (FIG. 3) of the ventilated mattress 10 on a bottom side of the base layer 22 and a cushioning element (e.g., the coil layer 300, etc.) on a top side of the base layer 22. The base layer 22 may also provide at least some support the elements superimposed over it.

In some embodiments, the base layer 22 may comprise a relatively stiff but somewhat flexible element. As an example, such a base layer 22 may be formed from a layer of a "structured foam," which may comprise a compressible foam material with an indentation load deflection (ILD) rating of about 40 or greater (e.g., 40, 45, 50, 55, 60, etc.). An ILD rating is the amount of pressure, converted to weight in pounds, it takes to indent a circular area of 50 square inches (i.e., lbs/50 $in^2$) over a four-inch thick piece of the structured foam by 25% (i.e., one inch). In a specific embodiment, the base layer 22 may comprise a layer of polyurethane foam with a nominal density of about 2.0 $lb/ft^3$ and an ILD rating of 50-55. Such a layer may have any suitable thickness (e.g., ½ inch, ¾ inch, 1 inch, 1¼ inch, 1½ inch, etc.).

The mattress base 20 may include an optional coil layer 300. As depicted by FIGS. 1-3 and FIGS. 6A-6C, the coil layer 300 may be positioned over the base layer 22. The coil layer 300 may include an array of coil springs 310 and an optional intervening layer 320 over the coil springs 310. Each coil spring 310 may comprise a collapsible, resilient coil (e.g., a metal (e.g., steel, etc.) coil, etc.). In a specific but non-limiting embodiment, each resilient coil may have a diameter of about 2.5 inches. The coil springs 310 comprise so-called "pocketed" coils, in which each coil is contained within a bag, or a sock. In some embodiments, the coil springs 310 may comprise pocketed coils of the types described by U.S. Patent Application Publication US 2019/0150632 A1, the entire disclosure of which is hereby incorporated herein.

The intervening layer 320 shown in FIGS. 1-3, 7A, and 7B, if any, may provide a barrier between the coil springs 310 and components of the ventilated mattress 10 positioned directly over the coil layer 300. More specifically, the intervening layer 320 may prevent the collapsible, resilient coils of the coil springs 310 from piercing or otherwise damaging any component of the ventilated mattress 10 directly over the coil layer 300. Even more specifically, the intervening layer 320 may provide a protective barrier that prevent the coil springs 310 from puncturing air chambers 410 of a pressurizable layer 400, if any, over the coil layer 300.

Accordingly, the intervening layer 320 may comprise a thin, flexible layer. In some embodiments, the intervening layer 320 may be compressible and resilient. Without limitation, the intervening layer 320 may comprise a polymeric film, a foam material (e.g., a structured foam, a foam rubber, etc.).

Figure 8A:
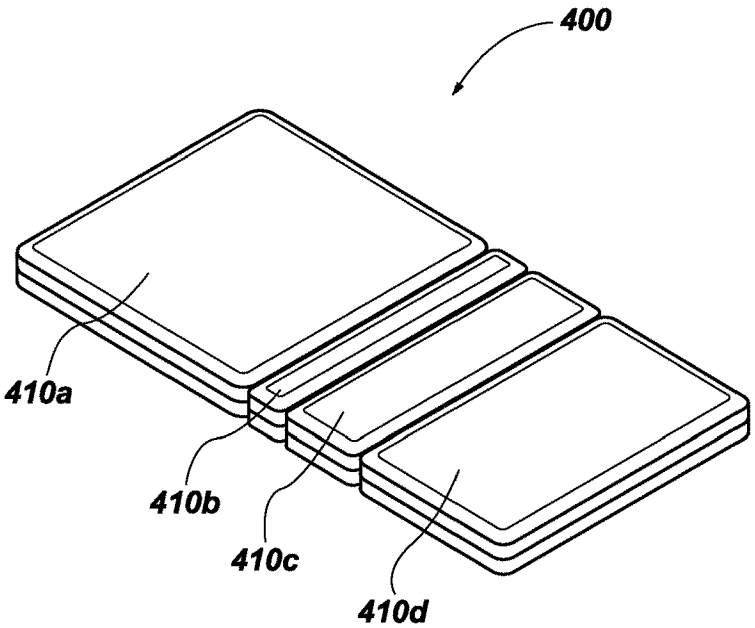
FIGS. 8A-8C respectively provide isometric, top, and side views of an embodiment of a pressurizable layer of the embodiment of ventilated mattress illustrated by FIG. 1.
Figure 8C:
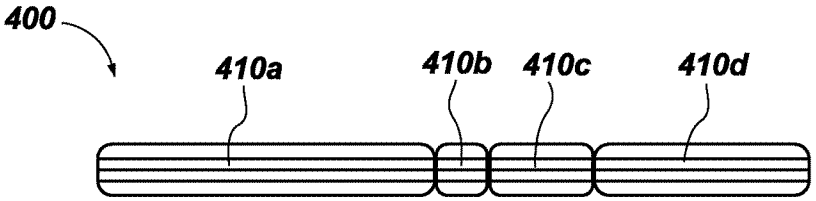
Figure 8B:
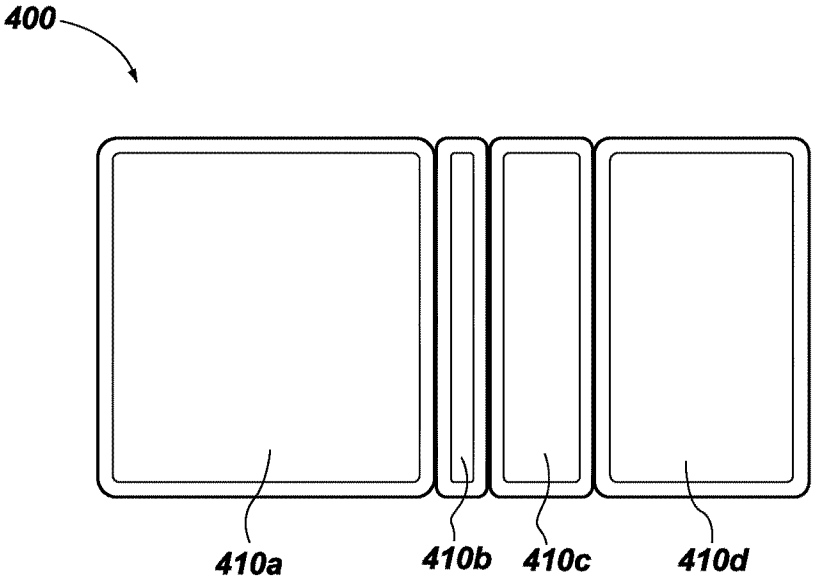
Figure 9A:
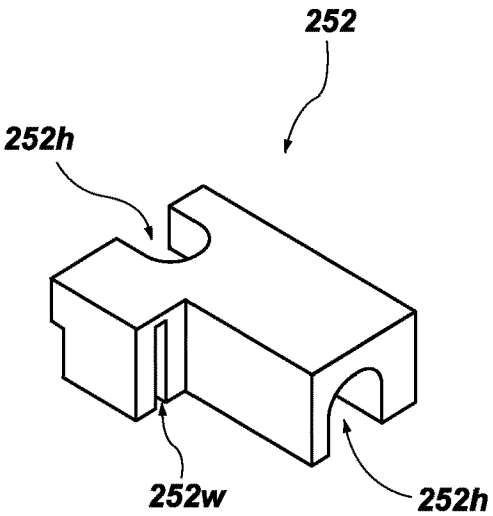
FIGS. 9A-9D respectively provide isometric, end, bottom, and side view of an embodiment of a support element of a ventilation system of the embodiment of ventilated mattress illustrated by FIG. 1.
Figure 9B:
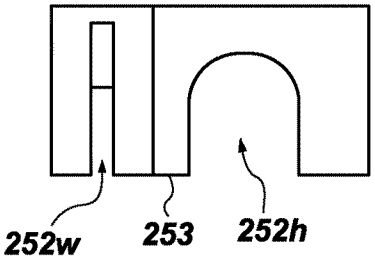
Figure 9C:
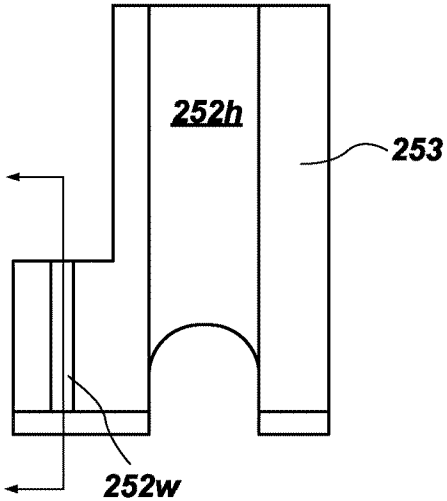
Figure 9D:
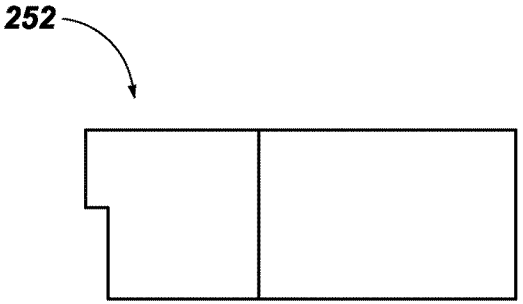
Figure 9E:
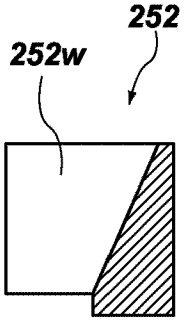
FIG. 9E provides a cross-section along line B-B through FIG. 9C.
Figure 10A:
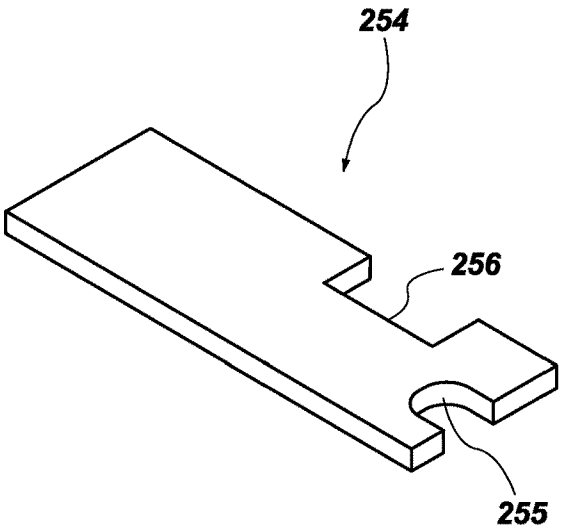
FIGS. 10A-10C respectively provide isometric, top, and side views of an embodiment of another support element of the ventilation system of the embodiment of ventilated mattress illustrated by FIG. 1.
Figure 10B:
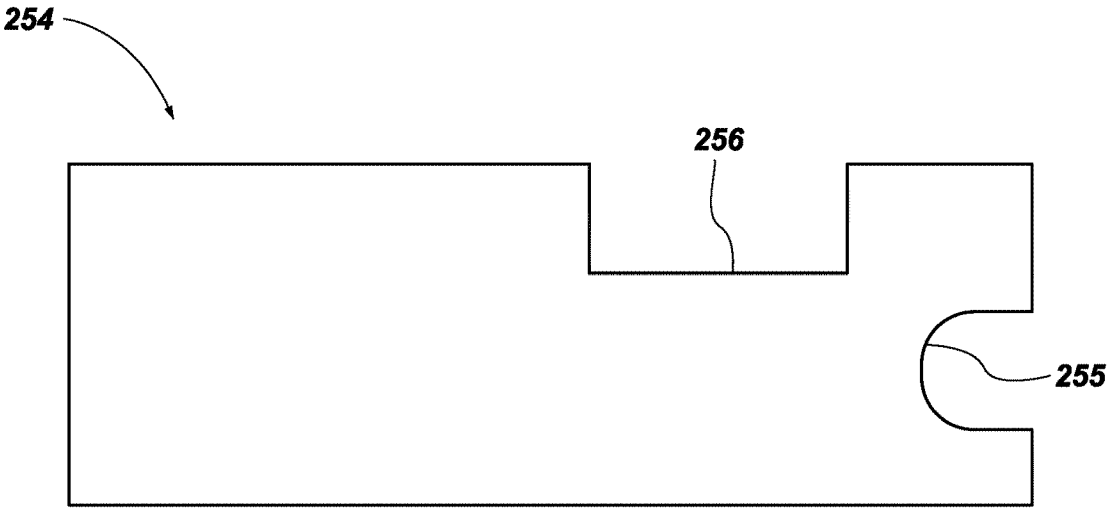
Figure 10C:
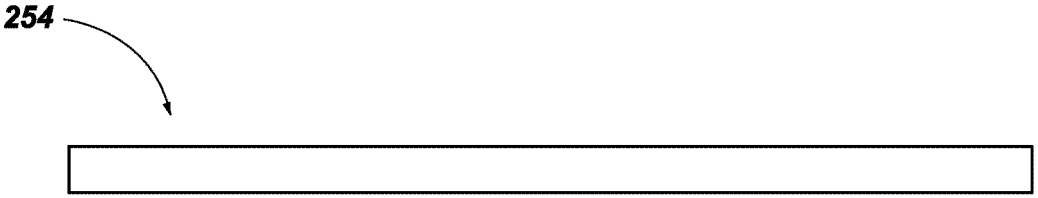

The mattress base 20 may include an optional pressurizable layer 400. In the embodiment of ventilated mattress 10 depicted by FIGS. 1-3 and as can be seen in FIGS. 8A-8C, the pressurizable layer 400 may be positioned over a coil layer 300. In other embodiments, the pressurizable layer 400 may be positioned over the base layer 22. The pressurizable layer 400 may comprise one or more air chambers 410 (air chambers 410*a*, 410*b*, etc.). The air chamber(s) 410 of the pressurizable layer 400 may be selectively inflated and/or deflated in any suitable manner known in the art. Each air chamber 410 may comprise a material that will enable the air chamber 410 to expand, or inflate, when the air pressure therein is increased; thus, each air chamber 410 may include one or more flexible walls. The material from which each air chamber 410 is formed may be impermeable to air (i.e., it may receive and substantially retain air for prolonged periods of time (e.g., months, years, etc.).

In some embodiments where the pressurizable layer 400 includes a plurality of air chambers 410, the air chambers 410 may be elongated and arranged parallel to one another; elongated air chambers 410 may be oriented across at least a portion of a width of the mattress base 20 of the ventilated mattress 10. For example, elongated air chambers 410 may be extend across non-peripheral areas of the mattress base 20. As another example, elongated air chambers 410 may extend across non-peripheral and non-midline areas of a side, or half, of the mattress base 20. In some embodiments, such a pressurizable layer 400 may have a configuration such as that disclosed by U.S. Provisional Patent Application No. 63/154,423, filed on Feb. 26, 2021 and titled CUSHIONING ELEMENTS WITH PRESSURIZABLE CELLS ("the '423 Application"), the entire disclosure of which is hereby incorporated herein. In other embodiments where the pressurizable layer 400 includes a plurality of air chambers 410, the air chambers 410 may have regular polygonal shapes (e.g., square, hexagonal, etc.) and be arranged in an array.

In some embodiments, the air chamber(s) 410 of the pressurizable layer 400 or groups of air chambers 410 may be removed and replaced. Removal and replacement of the air chamber(s) 410 may be useful in situations where an air chamber 410 fails, an upgraded air chamber 410 is desired, and the like.

The pressurizable layer 400 may comprise part of a pressurization system of the ventilated mattress 10. In addition to the pressurizable layer 400, the pressurization system may include one or more air pumps, conduits, electronics, and programming (not shown), as known in the art, which may be associated with the pressurizable layer 400 in a manner known in the art.

With continued reference to FIGS. 1-3 and with added reference to FIGS. 5A-5E, a foundation 21 of the mattress base 20 may include the base layer 22, as well as a frame 24. The frame 24 may include a plurality of rails 26*a*, 26*b*, 26*c*, 26*d* arranged about the periphery of the base layer 22 at the head (rail 26*a*), foot (rail 26*b*), and sides (rails 26*c* and 26*d*) of the ventilated mattress 10. For the sake of simplicity, each of the rails 26*a-d* may also be referred to herein as a "rail 26" and two or more of the rails 26*a-d* may be referred to as "rails 26."

The rails 26 of the frame 24 may comprise relatively stiff but somewhat flexible elements. As an example, the rails 26 may be formed from a layer of a structured foam. The rails 26 may be formed from the same structured foam as the base layer 22 or from a different (e.g., less rigid, etc.) structured foam. In a specific embodiment, the rails 26 of the frame 24 may comprise polyurethane foam with a nominal density of about 2.0 lb/ft$^3$ and an ILD rating of 35-55. In other embodiments, the rails 26 of the frame 24 may comprise a so-called "spacer fabric," such as that disclosed by U.S. Pat. No. 10,881,217, the entire disclosure of which is hereby incorporated herein.

In some embodiments, such as that depicted by FIGS. 1-3, the rails 26 of the frame 24 may surround an outer periphery of the base layer 22. In other embodiments, the rails 26 of the frame 24 may be positioned on peripheral portions of the base layer 22. Together, the frame 24 and the base layer 22 may define a receptacle, or a pocket 28.

The pocket 28 may receive the cushioning element(s) and any other internal elements of the mattress base 20, such as the optional coil layer 300 and pressurizable layer 400 depicted by FIGS. 1-3. Thus, the frame 24 may surround the cushioning element(s) and other interior components of the mattress base 20. The pocket 28 may have at least one lateral dimension (e.g., a length or a width) that exceeds the corresponding lateral dimensions of the cushioning element(s) of the mattress base 20. When the cushioning element(s) and any intervening or superimposed layers are positioned within the pocket 28, the extra space may define a receptacle 29 that receives ventilation equipment. In a specific embodiment, the receptacle 29 may extend along a foot end (i.e., within rail 26*b*) of the frame 24 of the mattress base 20 of the ventilated mattress 10.

As shown in FIGS. 5D-5G, one or more of the rails 26 may include ventilation features 27, such as the depicted apertures, or vents, that facilitate airflow therethrough. The ventilation features 27 may facilitate the flow of air from outside the ventilated mattress 10 into the receptacle 29 of the pocket 28 of the mattress base 20 of the ventilated mattress 10.

FIGS. 2 and 3 show that the receptacle 29 of the pocket 28 of the mattress base 20 may carry ventilation equipment, which comprises part of the ventilation system 200 of the ventilated mattress 10. The ventilation equipment may include one or more pumps 220, controls 230, and hoses 240. In addition, the receptacle 29 may carry supports 250, 252, 254 for the ventilation equipment.

The pump(s) 220 may comprise an air pump, a ventilation pump, or the like of any suitable type(s). The pump(s) 220 may draw air from a location outside the ventilated mattress 10, through the ventilation features 27 in the frame 24 of the mattress base 20, and into the receptacle 29 of the pocket 28 of the mattress base 20. In addition, the pump(s) 220 may force the air into other components of the ventilation system 200 and ultimately to a top surface 12 of the ventilated mattress 10.

The control(s) 230 may comprise any suitable, user-adjustable and/or program-adjustable (i.e., artificial intelligence (AI) adjustable) climate control system, which may enable an individual and/or programming of the control(s) 230 to control the manner in which air flows and, optionally, one or more characteristics of air flowing through the ventilated mattress 10. The control(s) 230 may control operation of the pump(s) 220 and, thus, the flow rate at which the pump(s) 220 force(s) air through the ventilated mattress 10. In some embodiments, the control(s) 230 may also control a temperature of the air flowing through the ventilated mattress 10 by heating and/or cooling the air to a selected temperature. The control system of the climate control system of the BedJet 3 Climate Comfort Sleep System available from BedJet of Newport, Rhode Island, is a non-limiting example of such (a) control(s) 230. See, e.g., U.S. Pat. Nos. 9,782,016 and 10,660,451 and U.S. Patent Application Publication US 2017/0340128 A1, the entire disclosures of which are hereby incorporated herein.

The hose(s) 240 may transport air from the pump(s) 220 and control(s) 230 to an air distribution layer 210 of the ventilation system 200.

The support 250 has a configuration that enables it to support the hose 240 from beneath. Thus, a thickness of the support 250 may enable the support 250 to support the hose 240 as pressure is applied to the top of the hose 240.

The support 252 has a configuration that enables it to support the hose 240 from above. As illustrated, the support 252 may include an elongated channel **252*h* that opens to a base 253 of the support 252 and that can receive the hose 240. A shape and dimensions of the elongated channel 252*h* may correspond to a shape and dimensions of a portion of the hose 240 the elongated channel 252*h* is designed to receive. Additionally, the support 252 may include channels and/or recesses 252*w* that receive other elements of the ventilation system 200. For example, a channel and/or recess 252*w* of the support 252 may receive one or more wires (e.g., electrical cables, etc.) that supply power to the pump(s) 220 and/or the control(s) 230**.

The supports 250 and 252 may be made from any of a variety of suitable materials. Since the supports 250 and 252 are intended to support elements of the ventilation system 200, such as the hose(s) 240, they may be made from a rigid, yet somewhat compressible material. Without limitation, the supports 250 and 252 may be made from a structured foam.

The support 254 may be made to extend over the components of the ventilation system 200 that are disposed within the receptacle 29. As illustrated, the support 254 may comprise a layer superimposed over the control(s) 230, the hose(s) 240, and the support 252. The support 254 may include a peripheral recess 255 that receives a portion of the hose(s) 240 and another peripheral recess 256 that accommodates a portion of the pump(s) 220. The support 254 may comprise a cushioning element that may prevent an individual from feeling at least some of the components of the ventilation system 200 through the ventilated mattress 10. Without limitation, the support 254 may comprise a foam (e.g., a foam rubber, a memory foam (e.g., a viscoelastic polyurethane foam, etc.), etc.). The support 254 may be made from a same material as the support layer 40 positioned thereover.

The support layer 40 may be positioned over the mattress base 20. In the embodiment illustrated by FIGS. 1-3, the support layer 40 may be positioned over the pressurizable layer 400 of the mattress base 20. The support layer 40 may also cover the receptacle 29 of the pocket 28 of the mattress base 20, as well as the ventilation equipment within the receptacle 29.

The support layer 40 may comprise a cushioning element that may provide an additional comfort layer over the base cushioning layer(s) and transmits variations in pressure from the pressurizable layer 400 to the layers (e.g., layers of the mattress top 30, etc.) of the ventilated mattress 10 located over the viscoelastic layer 500. Without limitation, the support layer 40 may comprise a foam material (e.g., a foam rubber, a memory foam, etc.). The support layer 40 may cover the frame 24 of the foundation 21 of the mattress base 20; i.e., it may be disposed on the rails 26 of the frame 24. In some embodiments, the support layer 40 may be secured to (e.g., with a suitable cement or other adhesive material, etc.) upper surfaces of the rails 26.

As another example, the support layer 40 may comprise a cushioning element with a plurality of resiliently compressible walls defining an array of resiliently buckling columns and a void within each column, such as the cushioning elements disclosed by U.S. Pat. Nos. 7,060,213, 7,076,822, and 8,919,750, which may be formed from any suitable material, including, but not limited to, an extended A-B-A triblock copolymer, such as those disclosed by U.S. Pat. Nos. 6,413,458, 6,797,765 and 7,964,664.

Figure 11B:
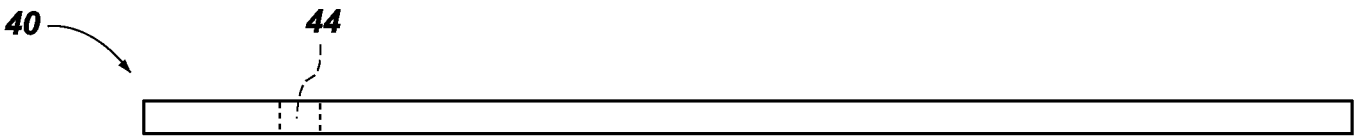
FIGS. 11A and 11B respectively provide top and side views of an embodiment of a support layer of the embodiment of ventilated mattress illustrated by FIG. 1.
Figure 11A:
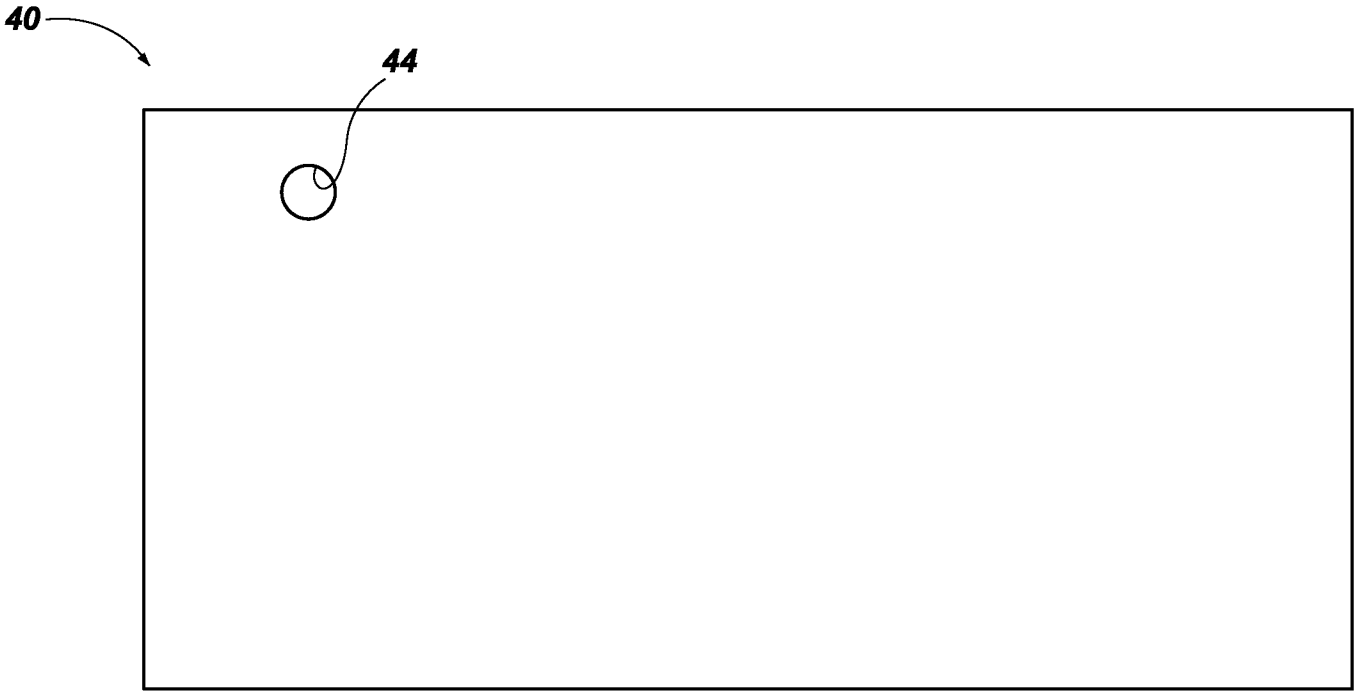
Figure 13A:
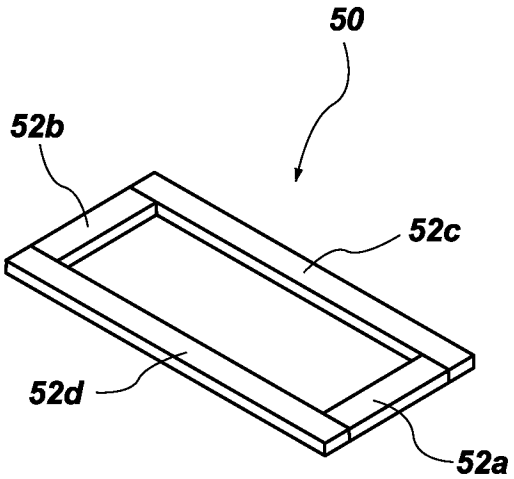
FIGS. 13A-13C respectively provide isometric, top, and side views of an embodiment of a top edge of a mattress top the embodiment of ventilated mattress illustrated by FIG. 1.
Figure 13C:
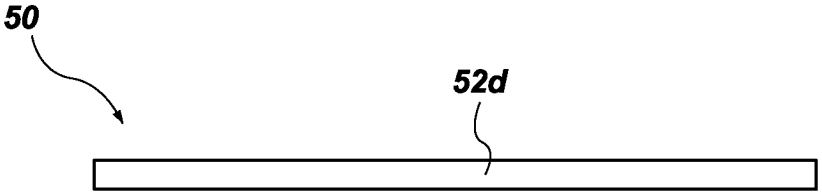
Figure 13B:
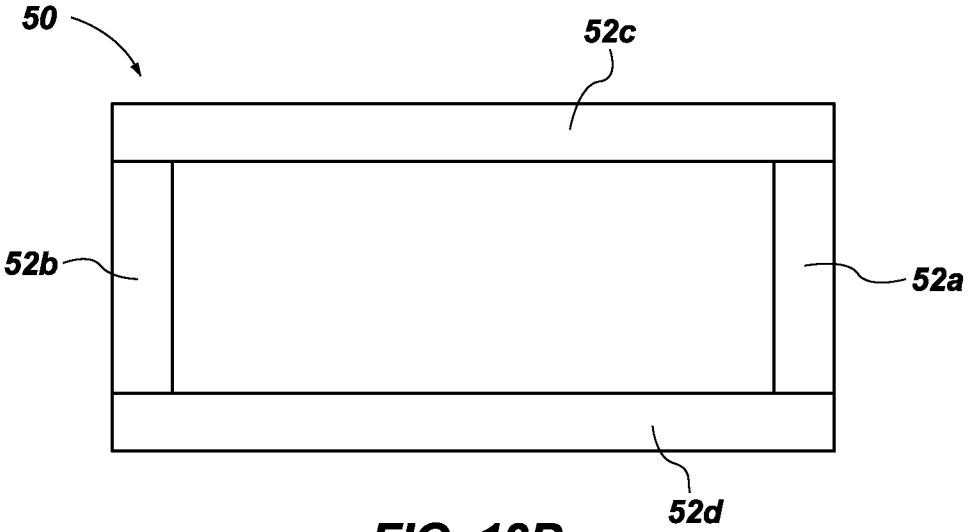
Figure 14A:
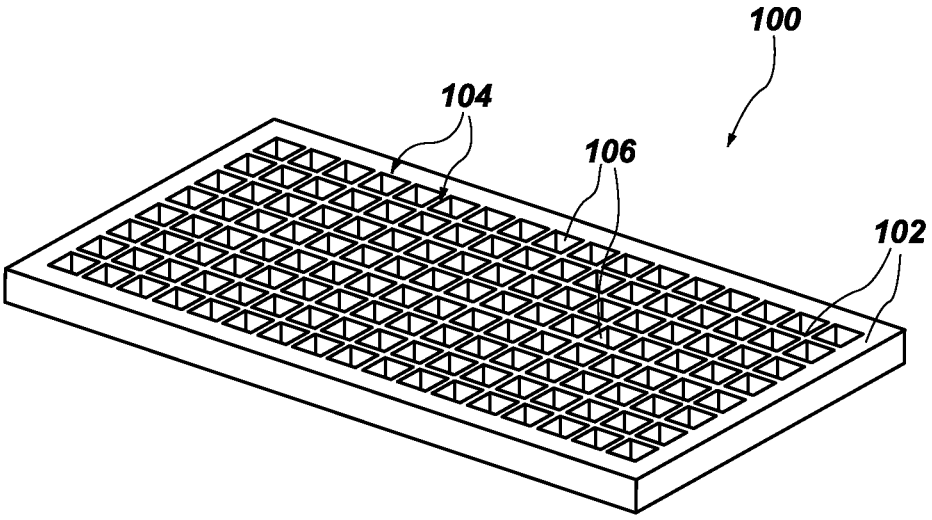
FIGS. 14A-14C respectively provide isometric, top, and side views of an embodiment of a gel cushion of the mattress top of the embodiment of ventilated mattress illustrated by FIG. 1.
Figure 14B:
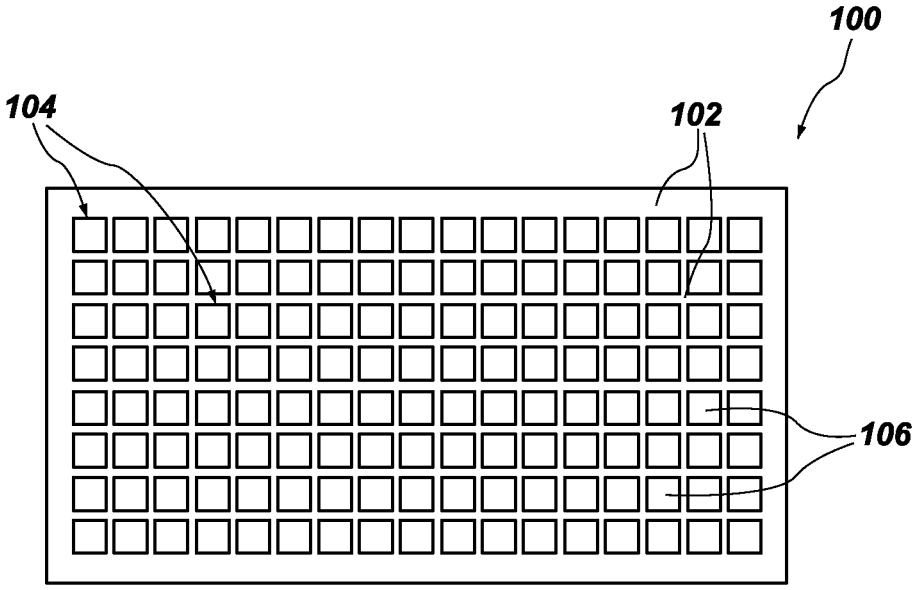
Figure 14C:
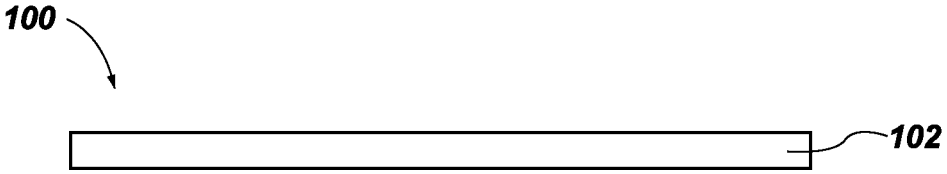

As FIGS. 11A and 11B illustrate, the support layer 40 may include an aperture 44 that accommodates a portion of a length of a hose 240 (e.g., a portion of the hose 240 adjacent to an end 244 thereof, etc.) of the ventilation system 200.

The air distribution layer 210 of the ventilation system 200 is positioned over the support layer 40. As shown in FIGS. 2 and 12A-12F, the air distribution layer 210 may comprise a substrate 211 that comprises a flexible layer. Without limitation, the substrate 211 of the air distribution layer 210 may comprise a flexible polymeric layer, an open cell foam, or a closed cell foam with features that limit the extent to which air may indiscriminately pass therethrough. An aperture 214 may extend through the air distribution layer 210. Channels 216, 218 may be defined in, or recessed in, and extend across an upper surface 212 of the air distribution layer 210. The channels 216, 218 may convey air to desired locations while minimizing losses in air pressure.

As FIGS. 12A and 12B depict, the aperture 214 extends through the air distribution layer 210. The aperture 214 may be aligned with the aperture 44 (FIGS. 11A and 11B) through the support layer 40. The aperture 214 may receive and retain an end 244 of the hose 240. Without limitation, a shape of the aperture 214 may correspond to a shape of the end 244 of the hose 240.

An embodiment of air distribution layer 210 that includes two sets of channels 216 is depicted. A first set **216*w* of channels 216 extends across a width of the air distribution layer 210, or horizontally across the air distribution layer 210. Ends of the channels 216 of the first set 216***w* are coincident with edges of the aperture 214, an arrangement that establishes flow communication between the aperture 214, the hose 240 therein, and the channels 216 of the first set 216*w*. The channels 216 of the first set 216*w* may be positioned to provide airflow to one or more desired locations on the top surface 12 of the ventilated mattress 10 (e.g., locations adjacent to a foot 15 of the ventilated mattress 10, etc.).

A second set 218*l* of channels 218 extends across a length of the air distribution layer 210, or longitudinally across the air distribution layer 210. Each channel 218 of the second set 218*l* intersects or crosses and communicates with at least one channel 216 of the first set 216*w*. Each channel 218 of the second set 218*l* may be positioned to provide airflow to one or more desired locations on the top surface 12 of the ventilated mattress 10 (e.g., across the top 10 of the ventilated mattress surface 12, etc.). The extent to which each channel 216, 218 conveys airflow to a particular location on the top surface 12 of the ventilated mattress 10 may correspond to a size (e.g., cross-sectional dimensions, etc.) of the channel 216, 218, the number of channels 216, 218 conveying airflow to the particular location, etc. The first set 216*w* of channels 216 may provide a first airflow, while the second set 218*l* may provide a second airflow. As illustrated, the channels 216 of the first set 216*w* are positioned more closely together, or more densely, than the channels 218 of the second set 218*l*. Thus, the first airflow over a first area occupied by the first set 216*w* (e.g., adjacent to the foot 15 of the ventilated mattress 10, etc.) may exceed the second airflow over a second area occupied by the second set 218*l* (e.g., a majority of the top 12 of the ventilated mattress 10, etc.).

As FIGS. 12E and 12F show, each channel 216, 218 may include a structural support 219 therein. The structural support 219 may comprise an air permeable element that prevents the channel 216, 218 from collapsing as pressure (e.g., as occurs under the weight of an individual on the top surface 12 of the ventilated mattress 10, etc.). The structural support 219 may be less resistant to airflow than the material that forms the substrate 211 of the air distribution layer 210. Without limitation, the structural support 219 may comprise a rigid open-celled foam, an engineered structure (e.g., a honeycomb structure with cells that define conduits extending along the length of the channel 216, 218, etc.), or the like.

Turning now to FIGS. 1-3 and 13A-13C, a top edge 50 may be positioned on or otherwise over an outer periphery 213 of the upper surface 212 of the air distribution layer 210. The top edge 50 may include four cushioning rails 52—two end rails 52*a* and 52*b* and two side rails 52*c* and 52*d*. The top edge 50 may define a receptacle 54, within which the gel cushioning layer 100 of the ventilated mattress 10 may be located.

The rails 52 of the top edge 50 may comprise relatively stiff but somewhat flexible elements. As an example, each rail 52 may be formed from a foam or a structured foam. An ILD rating of the rails 52 and, thus, the top edge 50 may exceed the ILD rating of a top layer 60 of the ventilated mattress 10. In a specific embodiment, the rails 52 of the top edge 50 may comprise polyurethane foam with a nominal density of about 2.0 $lb/ft^3$ and an ILD rating of 25-55. In some embodiments, the top edge 50 may comprise a spacer fabric of the type disclosed by U.S. Pat. No. 10,881,217.

The gel cushioning layer 100 may be located within the receptacle 54 defined by the rails 52 of the top edge 50, over the air distribution layer 210. The gel cushioning 100 layer may comprise a cushioning element with a plurality of resiliently compressible walls 102 defining an array of resiliently buckling columns 104 and a void 106 within each column 104. Embodiments of such cushioning elements are disclosed by U.S. Pat. Nos. 7,060,213, 7,076,822, and 8,919,750, the entire disclosures of which are hereby incorporated herein. The resiliently compressible walls 102 of the gel cushioning layer 100 may be formed from any suitable material, including, but not limited to, an extended A-B-A triblock copolymer, such as those disclosed by U.S. Pat. Nos. 6,413,458, 6,797,765 and 7,964,664, the entire disclosures of which are hereby incorporated herein.

The voids 106 defined by the array of resiliently buckling columns 104 may extend through an entire thickness of the gel cushioning layer 100. Thus, the channels 216, 218 of the air distribution layer 210 may be exposed to and communicate with the voids 106. With such an arrangement, air from channels 216, 218 may flow through the voids 106, toward the top surface 12 of the ventilated mattress 10.

The top layer 60 of the ventilated mattress 10 may be positioned over the top edge 50 and the gel cushioning layer 100. The top layer 60 provides desired cushioning properties and a desired firmness (e.g., ILD rating, etc.) for an individual as he or she lies on the ventilated mattress 10. The top layer 60 may have an ILD rating of about 12 to 16.5 (super-plush), 16.5 to 22.5 (plush), 22.5 to 26.5 (soft), 26.5 to 30.5 (medium), 30.5 to 34.5 (firm), 34.5 to 38.5 (extra-firm), or greater. The top layer 60 is also permeable to air, enabling air flowing from the voids 106 of the gel cushioning layer 100 to be communicated to the top surface 12 of the ventilated mattress 10. Without limitation, the top layer 60 may comprise an air permeable open cell foam (e.g., a foam rubber, a memory foam, etc.).

Together, the support layer 40, the air distribution layer 210, the top edge 50, the gel cushioning layer 100, and the top layer 60 may define the mattress top 30 of the ventilated mattress 10.

The cover 70 of the ventilated mattress 10 may be placed over and contain all of the interior elements, or interior components, of the ventilated mattress 10. The cover 70 may comprise a material (e.g., fabrics, etc.) that is permeable to air, which may enable airflow generated by the ventilation system 200 to be communicated to the top surface 12 of the ventilated mattress 10. In some embodiments, the cover 70 may be configured as described by U.S. patent application Ser. No. 17/176,498, titled COMPOSITE MATTRESSES WITH AIR CHAMBERS, the entire disclosure of which is hereby incorporated herein. In other embodiments, the cover 70 may be configured as described by U.S. Provisional Patent Application 63/164,358, titled MATTRESS ASSEMBLIES, the entire disclosure of which is hereby incorporated herein.

Such a cover 70 may include a base portion 72, a top portion 73, and a fastener 75. The base portion 72 may be positioned over the mattress base 20. The top portion 73 may be positioned over the mattress top 30. The fastener 75 (e.g., a zipper, etc.) may secure the base portion 72 and its contents to the top portion 73 and its contents.

The fabric of the top panel 73*t*, as well as peripheral portions 73*p* of the top portion 73 of the cover 70, peripheral portions 72*p* of the base portion 72 of the cover 70, and, optionally, a base panel 72*b* of the base portion 72 may comprise a stretchable material (e.g., a stretchable fabric, etc.). The stretchability of the material may enable an individual to experience the full cushioning effect of the cushioning elements of the ventilated mattress 10. Stated another way, the stretchability of the material may not limit the extent to which the ventilated mattress 10 (e.g., the top layer 60, the gel cushioning layer 100, etc., thereof) may cushion an individual sitting or lying on the ventilated mattress 10 or an object that has been placed on the ventilated mattress 10. Additionally, the stretchability of the material may enable complete or substantially complete (e.g., due to a thickness of the top panel 73*t*, etc.) transmission of the effects of pressurization of the support layer 40 on an upper surface of the top layer 60 through the top panel 73*t*. U.S. Patent Application Publication US 2017/0251825 A1, the entire disclosure of which is hereby incorporated herein, provides examples of stretchable materials that may be used to form the cover 70 or parts thereof.

In some embodiments where a base panel 72*b* of the base portion 72 of the cover 70 does not comprise the same material as a remainder of the cover 70, a non-stretchable material may form the base panel 72*b*. A fabric that is non-stretchable may stretch due to a weave of the fabric, but lack stretchable fibers. Such a fabric may comprise a so-called "non-skid" fabric.

The fastener 75 may comprise any apparatus(es) that may enable the mattress base 20 and mattress top 30 of the ventilated mattress 10 to be secured to each other. Without limitation, the fastener 75 may comprise one or more zippers. Other embodiments of fatteners 75 include other mutually engaging elements, such as buttons and buttonholes, snap-fit features, touch fasteners (e.g., so-called "velcro" fasteners, etc.), and the like.

In embodiments where the base portion 72 and top portion 73 of the cover 70 respectively contain the mattress base 20 and the mattress top 30, the base portion 72 and the top portion 73 may enable the mattress base 20 and mattress top 30 may be readily assembled with and disassembled from one another. In some embodiments, a single mattress base 20 may have a configuration that enables it to receive and be assembled with two or more mattress tops 30. In other embodiments, two or more mattress bases 20 may collectively receive a single mattress top 30 of the ventilated mattress 10. Thus, the separable mattress base 20 and mattress top 30 may impart a ventilated mattress 10 with modularity. More specifically, a mattress base 20 may be used with a plurality of different mattress tops 30 and/or a mattress top 30 may be used with a plurality of different mattress bases 30 to enable an individual or a couple to select mattress bases 20 and tops 30 with particular characteristics.

In some embodiments, a top panel 73*t* of the top portion 73 of the cover 70 may comprise a fabric that carries a resiliently compressible web on a surface (e.g., an underside, etc.) thereof. The resiliently compressible web may define a structured array, or a grid, of regular polygonal openings (e.g., a hexagonal array, or a hexagonal grid, of openings, etc.). The resiliently compressible web may be formed from any suitable material, such as an elastomeric material (e.g., an extended A-B-A triblock copolymer, such as those disclosed by U.S. Pat. Nos. 6,413,458, 6,797,765 and 7,964,664, etc.). In some embodiments, the resiliently compressible web of such a top panel 73*t* may be located between a pair of superimposed layers of fabric.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A mattress, comprising:
at least one base cushioning layer;
ventilation equipment;
an air distribution layer over the at least one base cushioning layer and including a plurality of channels that extend partially into the air distribution layer and receive airflow from the ventilation equipment, the plurality of channels including:
first channels extending across a width of the air distribution layer; and
second channels extending across a length of the air distribution layer and intersecting the first channels; and
a gel cushioning layer atop the air distribution layer.

2. The mattress of claim 1, wherein the at least one base cushioning layer comprises:
a first base cushioning layer; and
a second base cushioning layer.

3. The mattress of claim 2, further comprising:
an intervening layer between the first base cushioning layer and the second base cushioning layer.

4. The mattress of claim 2, wherein the first base cushioning layer comprises an array of mattress coils.

5. The mattress of claim 4, wherein the second base cushioning layer comprises an air bladder.

6. The mattress of claim 2, wherein the second base cushioning layer comprises an air bladder.

7. The mattress of claim 6, wherein the air bladder comprises a plurality of air chambers.

8. The mattress of claim 1, further comprising:
a support layer over the at least one base cushioning layer and supporting the air distribution layer.

9. The mattress of claim 1, further comprising:
a frame defining a pocket within which the at least one base cushioning layer and the ventilation equipment are located.

10. The mattress of claim 9, wherein the frame includes ventilation features that enable air to be drawn from locations outside of the mattress into the ventilation equipment of the mattress.

11. The mattress of claim 1, further comprising:
a foam layer covering the ventilation equipment, beneath the air distribution layer.

12. The mattress of claim 1, further comprising:
top edge on the air distribution layer and surrounding the gel cushioning layer.

13. The mattress of claim 1, wherein the gel cushioning layer comprises a grid defined by an elastomeric material and defining walls of an array of buckling columns.

14. A ventilated mattress, comprising:
at least one base cushioning layer;
ventilation equipment;
an air distribution layer over the at least one base cushioning layer and including channels that extend partially into the air distribution layer and receive airflow from the ventilation equipment the channels including:
first channels extending across a width of the air distribution layer; and
second channels extending across a length of the air distribution layer and intersecting the first channels; and a gel cushioning layer atop the air distribution layer, the gel cushioning layer including voids extending completely through a thickness thereof, the voids communicating with the channels to receive the airflow from the channels and communicate the airflow toward a top surface of the ventilated mattress.

15. The ventilated mattress of claim 14, wherein:

the first channels receive the airflow from the ventilation equipment and provide a first airflow to a first area of the top surface of the ventilated mattress; and the second channels receive the airflow from the ventilation equipment and provide a second airflow to a second area of the top surface of the ventilated mattress.

16. The ventilated mattress of claim 14, wherein the first channels are located adjacent to a foot of the ventilated mattress.

17. The ventilated mattress of claim 15, wherein the first airflow has a first rate that exceeds a second rate of the second airflow.

18. A method of manufacturing a ventilated mattress, comprising:

assembling a pump, a control, and a hose of a ventilation system within an interior of a mattress base, an end of the hose protruding from a top of the mattress base;

positioning an air distribution layer over the mattress base, the end of the hose extending to an aperture through the air distribution layer, channels extending partially into the air distribution layer and communicating with the aperture and the end of the hose, first channels of the channels extending across a width of the air distribution layer, second channels of the channels extending across a length of the air distibution layer and intersecting the first channels; and positioning a cushioning layer over the air distribution layer, voids extending through the cushioning layer communicating with the channels of the air distribution layer to enable air to flow through the cushioning layer.

19. The method of claim 18, wherein positioning the cushioning layer comprises positioning a gel cushioning layer over the air distribution layer.

20. The method of claim 19, wherein positioning the gel cushioning layer comprises positioning a gel cushioning layer having a grid configuration over the air distribution layer.

* * * * *